US005685353A

United States Patent [19]

Viitaniemi et al.

[11] Patent Number: 5,685,353

[45] Date of Patent: Nov. 11, 1997

[54] METHOD FOR COMPRESSIVE SHAPE-DRYING OF WOOD

[75] Inventors: Pertti Viitaniemi, Helsinki; Paavo Kontinen, Espoo, both of Finland

[73] Assignee: Valtion teknillinen tutkimuskeskus, Espoo, Finland

[21] Appl. No.: 553,665

[22] PCT Filed: May 17, 1994

[86] PCT No.: PCT/FI94/00199

§ 371 Date: Feb. 15, 1996

§ 102(e) Date: Feb. 15, 1996

[87] PCT Pub. No.: WO94/26485

PCT Pub. Date: Nov. 24, 1994

[30] Foreign Application Priority Data

May 18, 1993 [FI] Finland ..... 932246

[51] Int. Cl.[6] ..... B27M 1/02; B27M 1/00

[52] U.S. Cl. ..... 144/361; 100/38; 100/93 P; 144/380; 34/389

[58] Field of Search ..... 34/143, 145, 339, 34/356, 389, 396, 495; 100/38, 93 P; 144/359, 361, 380

[56] References Cited

U.S. PATENT DOCUMENTS

| | | | |
|---|---|---|---|
| 1,403,722 | 1/1922 | Turnbull | 144/361 |
| 1,480,658 | 1/1924 | Bostock | 144/361 |
| 1,644,801 | 10/1927 | Van Der Werff | 144/361 |
| 2,548,336 | 10/1951 | Banninger | 144/380 |
| 2,586,308 | 2/1952 | Curtis | 144/380 |
| 2,666,463 | 1/1954 | Heritage | 144/361 |
| 2,787,306 | 4/1957 | Lundstrom | 144/380 |
| 2,793,859 | 5/1957 | Darling et al. | 144/380 |
| 3,166,110 | 1/1965 | Hartesveldt et al. | 144/380 |
| 4,428,410 | 1/1984 | Stranberg | 144/361 |
| 5,190,088 | 3/1993 | Thomasson et al. | 100/38 X |

FOREIGN PATENT DOCUMENTS

| | | | |
|---|---|---|---|
| 216911 | 11/1967 | Sweden . | |
| 1129733 | 10/1968 | United Kingdom . | |
| 1426555 | 3/1976 | United Kingdom . | |
| 9429089 | 12/1994 | WIPO | 144/380 |

OTHER PUBLICATIONS

Derwent's Abstract, No. 85-247595/40, Week 8540, Abstract of SU, 1144883-A (Voron Forestry Inst.), Mar. 15, 1985.

*Primary Examiner*—W. Donald Bray

*Attorney, Agent, or Firm*—Birch, Stewart, Kolasch & Birch, LLP

[57] ABSTRACT

The invention is related to a method and apparatus for compressive shape-drying of wood (1). In the first phase of the method, green wood is compressed to a desired shape simultaneously heating the wood. According to the invention, during the first phase the wood (1) is compressed against gas-permeable surfaces (3, 4) rapidly to a desired and thickness. during the second phase of the compression process, the compression pressure is lowered to a level causing a thickness reduction equal to or greater than the thickness reduction caused by the drying of the wood, and the internal temperature of the wood is lowered with the progress of the compression process.

10 Claims, 1 Drawing Sheet

Pressure kp/cm2

Fig. 1
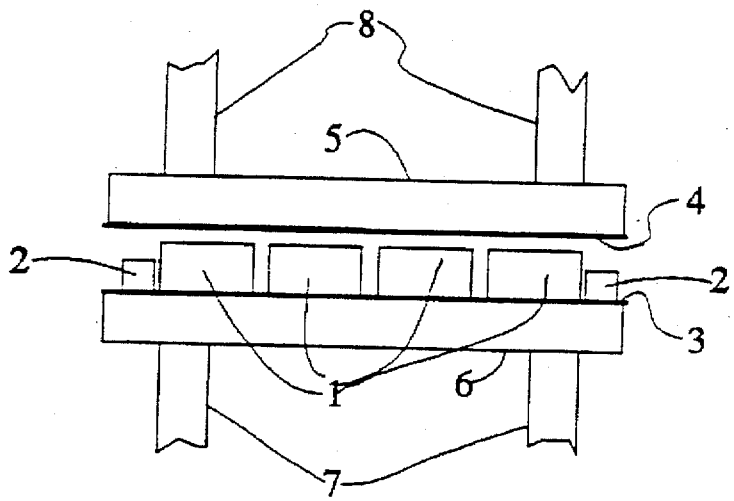
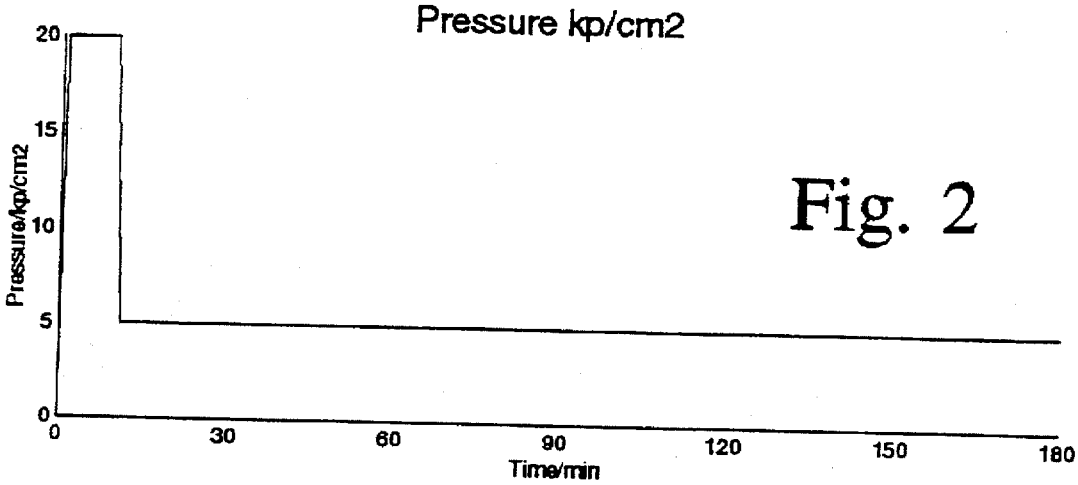
Fig. 2
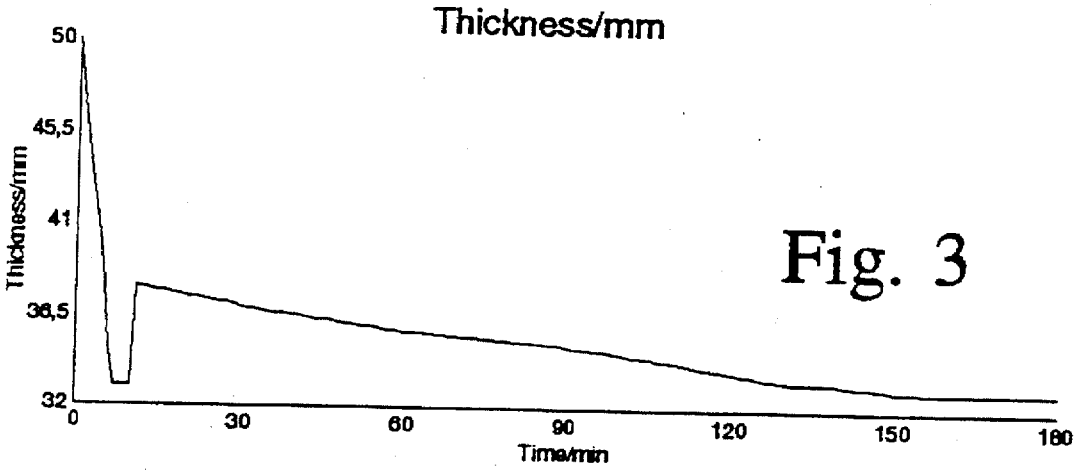
Fig. 3

METHOD FOR COMPRESSIVE SHAPE-DRYING OF WOOD

The invention is related to a method according to claim 1 for compressive shape-drying of wood.

Methods are known in the art in which dry wood is compressed to improve the surface hardness of wood. In these methods the compression operation is preceded by a drying phase which is extremely energy-hungry and time-consuming.

Corresponding methods developed for green wood are applicable to deciduous wood only. Such prior-art methods have caused cracks in the compression set wood that impair the quality of the end product.

It is an object of the present invention to achieve an entirely novel method and apparatus for compressive shape-drying of wood.

The invention is based on a process in which green wood is compressed in a first phase rapidly with a high pressure, and subsequent to said compression phase, the wood is allowed to recover toward its initial dimensions, and after these phases, the compression is continued with a low pressure toward a desired compressed end dimension. At the start of the compression phase the wood is kept at a temperature of approx. 150° C., and at the end of the workphase the temperature is advantageously approx. 125° C.

More specifically, the method according to the invention is characterized by what is stated in the characterizing part of claim 1.

The invention provides significant benefits.

The invention is particularly advantageous in the treatment of nordic grades of coniferous wood. The method is environmentally safe as wood color can be varied by a single process without the use of hazardous chemicals. The present drying process is rapid with reference to conventional drying methods. Furthermore, the variations of the method offer a controlled technique to modify the surface hardness, strength and stiffness as well as color change properties of the wood.

In the following the invention is examined in greater detail with reference to exemplifying embodiments illustrated in the annexed drawing in which:

FIG. 1 is a side view of a compression apparatus suited for implementing the invention;

FIG. 2 is a pressure-time graph of the process according to the invention; and

FIG. 3 is a thickness-time graph of the process represented in FIG. 2.

With reference to FIG. 1, the compression apparatus comprises an upper compression plate 5, top support columns 8 of the upper compression plate, and a lower compression plate 6 with hydraulic actuator cylinders 7. The wood-facing surfaces of the plates are heatable. Both plate surfaces are coated with steam-permeable wires 3 and 4, whose material can be, e.g., perforated sheet metal or metal fabric. The planks 1 to be compressed are placed between the wire fabrics 3 and 4, and the compression stroke is limited by backing gages 2 placed at the edges of the compression platens 5 and 6.

With reference to FIG. 2, compression is commenced with a high initial pressure of 20 kg/cm$^2$, which is maintained according to the exemplifying embodiment for 10 min. Next, the compression pressure is lowered to 5 kg/cm$^2$. Compression at this lower pressure level is maintained for 2 h 50 min.

With reference to FIG. 3, the thickness of a plank having a cross section of 50×100 mm (height×width) is reduced in the first compression phase to the height of the gages 2 (33 mm), then partially recovering toward the initial plank thickness reaching 37 mm thickness when the compression pressure is reduced to 5 kg/cm$^2$. Subsequently, the low compression pressure gradually compresses the plank toward the final thickness determined by the height of the gages 2. As a rule, the compression pressure used in this phase is such that it permits the thickness recovery of the plank by approx. 10% of the maximum thickness compression attained during the first phase; however, the applied low pressure must be at least so high as to achieve a compression equal to the natural thickness reduction caused by the drying of the wood, whereby the occurrence of internal honeycomb cracks is avoided.

The temperature of the compression plates 5 and 6 is adjusted such that the steam pressure corresponding to the temperature measured inside the wood 1 remains smaller than the applied compression pressure, whereby the steam expansion is prevented from causing cracks already during the compression phase. The goal of the elevated temperature is to achieve shorter compression time. The surface temperatures of plates are controlled in the range 150°–125° C.

The control of the compression pressure is implemented by allowing the compression plates to rest against the gages 2 for a while just before the press is decompressed.

The applied compression time and temperature are determined by the desired end moisture content of the wood. The goal is to attain an end moisture content not greater than 3%.

The internal temperature of the wood is typically controlled to approx. 150° C. at the start of the compression phase, and the temperature is lowered to approx. 125° C. at the end of the compression phase, whereby any risk of steam expansion at the decompression of the press is avoided.

The method according to FIGS. 2 and 3 was developed as a result of the following tests:

Test 1

A green pine plank (50×100 mm$^2$) was compressed at 150° C. The height of the gages was 33 mm and the compression pressure was 20 kg/cm$^2$, whereby the compression platens continuously approached each other until stopped by the gages in approx. 10 min. Thereinafter, the compression platens were kept resting against the gages for the entire duration of the compression time. The duration of the compression phase was 4 hours, and when the press was decompressed, bangs caused by steam expansion were heard and multiple checks were found on the plank surfaces.

Test 2

This test was otherwise similar to Test 1 with the exception that the upper and lower surfaces of the planks were covered by wire fabrics in accordance with FIG. 1. When the press was decompressed after 4 hours compression time, no steam expansion bangs occurred and the plank surfaces remained intact. After cross-cut sawing the planks at their mid-length, internal cracks were found. Such inside splits were caused by contraction of the wood during the drying phase.

By conducting the process according to the time-pressure graphs of FIGS. 2 and 3, both the steam expansion bangs and the internal checks could be obviated.

Relative thickness reduction by compression (in per cent from initial thickness) is advantageously in the range of 20–50% depending on the wood grade. The maximum practicable thickness reduction for coniferous wood is 40%, and for deciduous wood, 50%.

The typical compression pressures applied during the first compression phase are in the range of 15–20 kg/cm$^2$.

Typical duration of the first, rapid compression phase is approx. 3–10% of the total duration of the compression process. In the example illustrated in FIGS. 2 and 3, the first compression phase takes up approx. 5% of the total compression time.

We claim:

1. A method for compressive shape-drying of wood, said method comprising:

(a) raising the internal temperature of the wood to a predetermined temperature, then compressing the wood in a first phase rapidly to a desired shape against gas-permeable surfaces down to a desired thickness dimension while simultaneously controlling the internal temperature of the wood, (b) during a second phase of the compression process, the compression pressure is then lowered to a level causing a thickness reduction equal to or greater than the thickness reduction caused by drying of the wood, and meanwhile, the internal temperature of the wood is lowered with the progress of the compression process of steps (a) and (b).

2. The method as defined in claim 1, wherein the wood is compressed during the second phase using such a pressure that permits the wood thickness to recover by approx. 10% of the maximum thickness reduction attained during the first phase.

3. The method as defined in claim 1, using a wood internal temperature of 150° C. at the start of the process wherein the internal temperature of the wood is lowered to 125° C. toward the end of the second phase.

4. The method for compressive shape-drying of wood as defined in claim 1, wherein the relative thickness reduction is in the range of 20–40%.

5. The method for compressive shape-drying of wood as defined in claim 1, wherein the compression pressures during the first phase are approx. 15–20 kg/cm$^2$, and during the second phase, approx. 5 kp/cm$^2$.

6. The method for compressive shape-drying of wood as defined in claim 1, wherein the duration of the first compression phase is 3–10% of the total compression time, preferably approx. 5 %.

7. The method for compressive shape-drying of wood as defined in claim 2, wherein the duration of the first compression phase is 3–10% of the total compression time, preferably approx. 5%.

8. The method for compressive shape-drying of wood as defined in claim 3, wherein the duration of the first compression phase is 3–10% of the total compression time, preferably approx. 5%.

9. The method for compressive shape-drying of wood as defined in claim 4, wherein the duration of the first compression phase is 3–10% of the total compression time, preferably approx. 5%.

10. The method for compressive shape-drying of wood as defined in claim 5, wherein the duration of the first compression phase is 3–10% of the total compression time, preferably approx. 5%.

* * * * *